US010253988B2

(12) United States Patent
Colozzo et al.

(10) Patent No.: US 10,253,988 B2
(45) Date of Patent: Apr. 9, 2019

(54) DIRECT-HEATING FAN OVEN

(71) Applicant: WHIRLPOOL EMEA S.P.A., Pero (MI) (IT)

(72) Inventors: Vincenzo Colozzo, Gualdo Tadino (IT); Sandro Ciccacci, Sassoferrato (IT); Alberto Gasparini, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 82 days.

(21) Appl. No.: 15/102,327

(22) PCT Filed: Dec. 15, 2014

(86) PCT No.: PCT/IB2014/066899

§ 371 (c)(1),
(2) Date: Jun. 7, 2016

(87) PCT Pub. No.: WO2015/092640

PCT Pub. Date: Jun. 25, 2015

(65) Prior Publication Data

US 2016/0320072 A1 Nov. 3, 2016

(30) Foreign Application Priority Data

Dec. 17, 2013 (IT) ..... TO2013A1033

(51) Int. Cl.
*F24C 15/32* (2006.01)
*F24C 14/02* (2006.01)

(52) U.S. Cl.
CPC ..... *F24C 15/325* (2013.01); *F24C 14/02* (2013.01)

(58) Field of Classification Search
CPC ..... F24C 15/325; F24C 14/02; F24C 15/32; F24C 15/322; F24C 14/00
See application file for complete search history.

(56) References Cited

U.S. PATENT DOCUMENTS 4,410,779 A * 10/1983 Weiss ..... H05B 6/72 219/685
6,316,749 B1 * 11/2001 Bales ..... F24C 14/02 219/396
2012/0211482 A1 * 8/2012 Hertzberg ..... F24C 15/322 219/400

FOREIGN PATENT DOCUMENTS

DE 10211522 9/2003
EP 2607797 6/2013

* cited by examiner

*Primary Examiner* — Shawntina Fuqua
(74) *Attorney, Agent, or Firm* — Price Heneveld LLP

(57) ABSTRACT

The present invention relates to an oven comprising: a muffle that defines a cooking cavity for containing foods to be cooked, the muffle comprising at least one horizontal floor, heating means adapted to heat air, ventilating means adapted to circulate the air, at least one air distribution element comprising at least one channel adapted to receive the air being circulated and to allow it to flow through, wherein the distribution element further comprises a plurality of inlet openings in fluidic connection with the at least one channel and adapted to supply air into said cooking cavity; the ventilating means comprise at least one fan in fluidic connection with the distribution element, the fan being placed at least partially under the level of the horizontal floor.

12 Claims, 4 Drawing Sheets

DIRECT-HEATING FAN OVEN

TECHNICAL FIELD

The present invention relates to a fan oven, in particular for household use.

PRIOR ART

Fan ovens according to the prior art comprise a cooking cavity that is heated by suitable heating means, and ventilating means, such as one or more fans, associated with the heating means for circulating hot air inside the cooking cavity. The foods contained in the cooking cavity are hit by the hot air current and cooked.

In production ovens, the ventilated cooking system normally comprises a bulkhead, a fan, and a circular resistor. The bulkhead performs the task of dividing the space of the muffle into two parts, i.e. a first part where food is placed for cooking, and a second part where air is heated. The fan performs the task of giving kinetic energy to the air, which then enters the cooking cavity through slots typically arranged at the sides of the bulkhead, and is recovered through a grid, called a return grid, arranged in front of the bulkhead.

The air flowing from the bulkhead into the cooking cavity through the side slots typically has a hardly controllable chaotic motion, which also depends on the direction of rotation of the fan. In particular, the cooking of the food placed in the central region of the cavity is related to the return of the air, which in that region is normally colder and, for this reason, may cause uneven cooking and browning of the food. This type of cooking can be defined as "passive" cooking.

A further example of a fan oven according to the prior art is described in patent application EP2607797A2 by Indesit Company S.p.A., which relates to an oven of the ventilated type that comprises: a muffle that defines a cooking cavity, heating means associated with the muffle for heating the air, a fan for circulating air inside the muffle, positioned in an interspace of the back wall of the muffle, behind a bulkhead. The fan oven known from patent application EP2607797A2 envisages that the fan interspace is in fluidic connection with the muffle compartment for supplying hot air into the muffle itself, and that there are return means allowing the air in the muffle to be sucked by the fan into the interspace and heated again. The solution known from patent application EP2607797A2 envisages the presence of a channel proximal to the front wall of the muffle, through which air it taken from the muffle.

Fan ovens in known configurations like the one exemplified above still suffer, however, from a few drawbacks.

In particular, the temperature distribution inside the muffle is not sufficiently even, and is adversely affected by the fluid dynamics imposed by the oven, which condition the hot air flow coming from the heating element.

Therefore, the efficiency of the fan ovens known in the art is not adequate for the food cooking process that must take place inside said cooking cavity.

This problem is particularly felt when multiple foods must be cooked simultaneously in the cooking cavity on different trays arranged at different levels. It has been observed that, when several shelves or pans are placed at different levels in the cooking cavity, the foods contained therein get cooked differently.

Furthermore, such dishomogeneousness of the air distribution in the cooking cavity is also observed, to some extent, at each level of the cooking cavity, since foods get cooked differently even when they are put on the same shelf.

It is clear that this inevitably poses significant difficulties to the user, who will find it impossible to attain a homogeneous cooking of foods placed in the cooking cavity.

Furthermore, the generic configurations envisaged by the prior art share the fact that they do not take appropriately into account the fluid dynamics existing in the cooking cavity, leading to the risk of problems arising during the use of the fan oven.

OBJECTS AND SUMMARY OF THE INVENTION

It is one object of the present invention to provide a fan oven capable of solving some of the problems suffered by the prior art.

In particular, it is one object of the present invention to provide a fan oven which is so designed as to ensure that the hot air flow will be distributed evenly inside the cooking cavity.

It is another object of the present invention to provide a fan oven which is so designed as to ensure an effective circulation of the air flow between the heating elements and inside the cooking cavity.

It is a further object of the present invention to provide a fan oven which is so designed as to ensure a better cooking of the foods, even when the latter are simultaneously placed in the cooking cavity at different levels.

It is a further object of the present invention to provide a fan oven that optimizes the fluid dynamics in the cooking cavity.

It is a further object of the present invention to provide a fan oven that optimizes the fluid dynamics in the air circulation ducts, under the action of the ventilating means.

These and other objects are achieved through a fan oven as set out in the appended claims, which are an integral part of the present description.

A basic idea of the present invention is to provide an oven comprising: a muffle that defines a coking cavity for containing foods to be cooked, the muffle comprising at least one horizontal floor, heating means adapted to heat air, ventilating means adapted to circulate the air, at least one air distribution element comprising at least one channel adapted to receive the air being circulated and to allow it to flow through, wherein the distribution element further comprises a plurality of inlet openings in fluidic connection with the at least one channel and adapted to supply air into the cooking cavity; the ventilating means comprise at least one fan in fluidic connection with the distribution element, the fan being placed at least partially under the level of the horizontal floor.

This solution improves the air circulation through the heating elements and inside the cooking cavity.

This solution also optimizes the fluid dynamics in the air circulation duct, under the action of the ventilating means.

Thus, the invention envisages to modify the air heating and circulation system in order to attain an "active" type of cooking.

Further advantageous and particular aspects will become apparent from the following detailed description and from the dependent claims.

BRIEF DESCRIPTION OF THE DRAWINGS

Some preferred and advantageous embodiments will now be described by way of non-limiting example with reference to the annexed drawings, wherein.

The drawings show different aspects and embodiments of the present invention and, where appropriate, similar structures, components, materials and/or elements are designated in the various drawings by the same reference numerals.

DETAILED DESCRIPTION OF THE INVENTION

Figure 1:
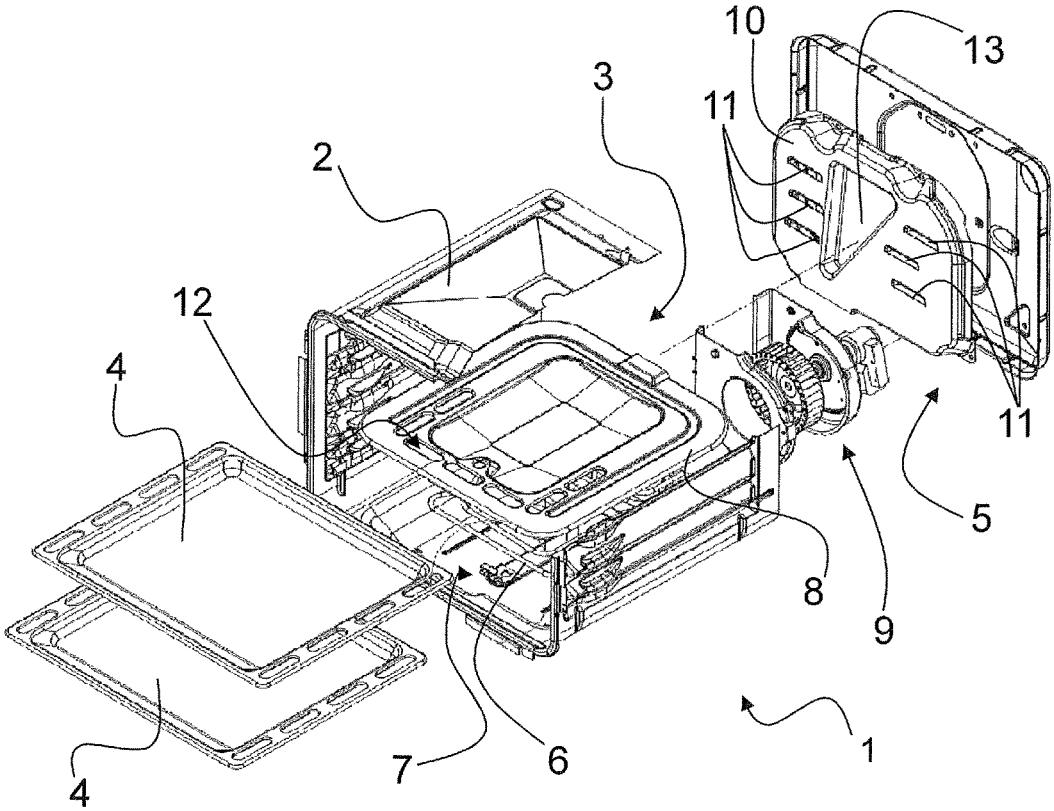
FIG. 1 is an exploded view of a first embodiment of an oven according to the present invention.

FIG. 1 shows an exploded view of an oven 1 comprising a muffle 2 that defines a cooking cavity 3 for containing foods to be cooked, which are typically placed on pans 4, or shelves and trays, that can be inserted into the cooking cavity 3.

The muffle 2 comprises at least one vertical back wall 5 and heating means 6 adapted to heat air; the heating means 6 are enclosed in a tray 7 positioned underneath the cooking cavity 3, separated from the latter by a dividing floor 8.

The oven 1 further comprises ventilating means, such as at least one fan 9, adapted to circulate the air inside the oven 1. The fan 9 is thus in fluidic connection with the distribution element 5, and is positioned under the level of the horizontal floor 8. Therefore, the tray 7 is in fluidic connection with the fan 9. A space, i.e. the tray 7, is thus dedicated to housing a heating element 6 in the base of the muffle 2, and a dividing floor 8 confines the space dedicated to the heating element 6 and provides return slots or openings 12 through which the air is recovered after having yielded its heat to the foods being cooked.

More in particular, the fan 9 comprises an impeller in fluidic connection with the region underneath the horizontal floor 8 on the upstream side relative to the direction of circulation of the heated air. At the same time, on the downstream side relative to the direction of circulation of the heated air, the impeller of the fan 9 is in fluidic connection with the distribution element 5.

According to a preferred embodiment, the impeller of the fan 9 is of the centrifugal type, with an axial inlet for said heated air, and a radial outlet for said heated air.

Further embodiments may envisage the presence of one or more fans, even of different types, e.g. tangential fans, axial-centrifugal fans, etc., which may alternatively be used with the same hot air intake and distribution system described herein.

Due to the presence of the heating element 6 in the tray 7, energy is saved because the main heating element 6 is located under the bottom of the cooking cavity 3; therefore, in addition to heating air for convective cooking, it also participates in heating the floor 8, which thus becomes an active hot surface without requiring an additional heating element dedicated thereto.

The oven 1 then comprises at least one air distribution element 10 associated with the vertical back wall 5 and comprising at least one channel 10 (or 10*a* and 10*b*) adapted to receive the heated air circulated by the fan 9 and to allow it to flow through.

The distribution element 5 comprises a plurality of inlet openings 11, which are in fluidic connection with the channel 10 and are adapted to supply the heated air into the cooking cavity 3.

The inlet openings 11 are positioned, preferably in pairs, at different levels on the distribution element 5; preferably, each opening of a pair is located on one of the different channels 10*a* and 10*b*.

The channel 10 preferably comprises a confining element 13 adapted to reduce the cross section available for the heated air as it flows through the space between two inlet openings located at different levels on the distribution element 5.

This provides a reduction of the cross section as the air covers the path within the distribution element 5, resulting in a balanced air flow between the air inlets that are closer to the fan 9 and those that are farther from the fan 9, whether at the same level or, most importantly, at different levels. In this way it is possible, among other things, to optimize and even out the cooking of the foods.

Preferably, the fan 9 is of the centrifugal type and is positioned underneath the distribution element 5. Preferably, the fan 9 comprises, therefore, a centrifugal impeller and an associated scroll that increases the efficiency of the impeller, the task of which is to suck air from the slots 12 of the floor 8 through the heating element 6 and direct it towards the distribution element 5.

The hot air distribution element 5 then comprises a bulkhead 10 with front slots or inlet openings 11, which exploit the Coanda effect. For this purpose, each one of the inlet openings 11 further comprises a deflecting element (not visible in the drawing) internal to the channel 10, and further comprises a surface (not shown) adapted to cooperate with an inner wall of the channel 10, so shaped as to allow the heated air flow to be deflected into the cooking cavity 3. Preferably, said shape of the internal deflecting element and of the surface is obtained by drawing the inlet openings 11. As aforesaid, the inlet openings 11 are located at different levels to serve the cooking shelves 4 in a more uniform manner.

The air that has exchanged heat by convection with the foods is preferably recovered in the front part of the cavity 3, where slots 12 are provided on the floor 8. The centrifugal fan 9 downstream of the slots 12 sucks this air, causing it to flow through the heating element 6 for heating it again.

Figure 2:
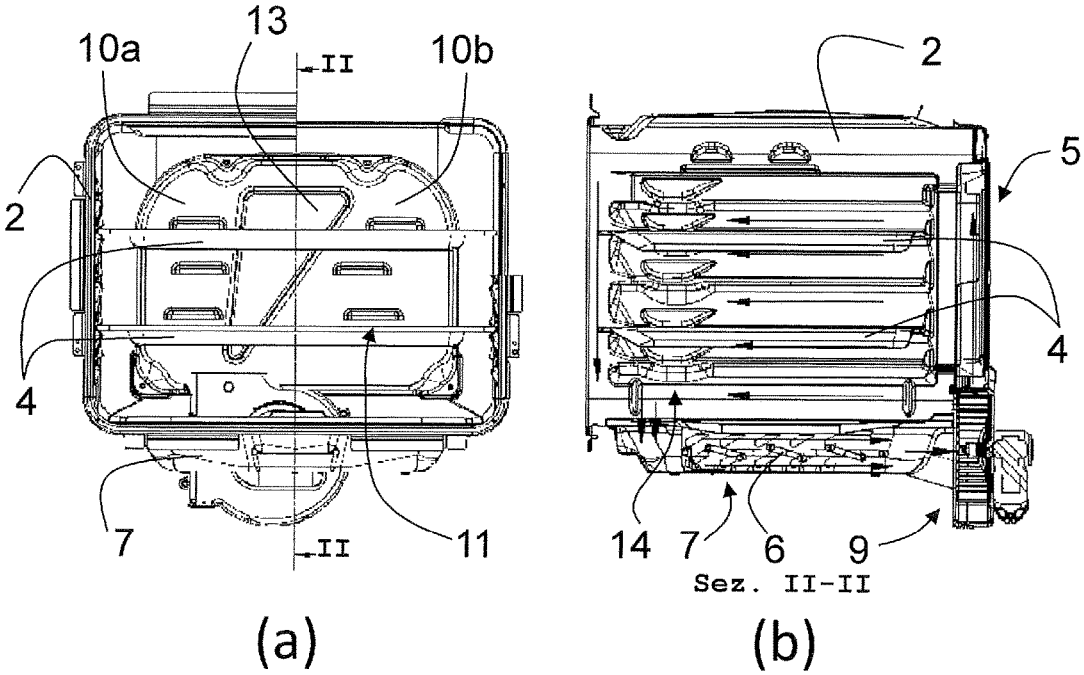
FIG. 2 shows a front view (a) and a sectional view (b) of the oven of FIG. 1.

As better shown in FIG. 2, the oven 1 preferably comprises a first channel 10*a* and a second channel 10*b*. Each one of the channels 10*a* and 10*b* comprises respective inlet openings 11 as already described. The reduction of the available cross section is obtained by means of a confining element 13 interposed between the first channel 10*a* and the second channel 10*b*; the confining element 13 defines a volume that preferably has a triangular section in projection on the vertical back wall, as shown in part (a) of FIG. 2.

The oven 1 then comprises support means 14 for at least one pan 4 inside the cooking cavity 3, as shown in the sectional view of part (b) of FIG. 2. The support means 14 are positioned at a plurality of heights compatible with the different levels of the inlet openings 11, so that there is at least one inlet opening 11 higher than said pan 4 positioned at any level defined by the support means 14. The openings 11 are thus configured for ensuring that the various shelves 4 will be hit by a heated air current, such that the cooking will be more uniform on each shelf 4 and also among the various shelves 4. In particular, the hot air circulation is represented in part (b) of FIG. 2 by straight arrows indicating the direction of circulation of the flow.

In one embodiment, the oven 1 further comprises sensing means, such as switches, adapted to detect the presence of at least one pan 4 (wherein said pan 4 is suitably configured as a partition, and hence is called "divider") at a specific level defined by the support means 14. In such an embodiment, the oven 1 further comprises means adapted to change the opening configuration of at least one of the inlet openings 11. Such means may comprise movable deflectors or baffles that may be operated mechanically or by electric actuators or motors, by means of which the heated air can be selectively made to exit through specific inlet openings 11. In this manner, it is possible to exploit the insertion of a "divider" such as the pan 4 for partitioning the cooking cavity 3 and obtaining a more effective heating without wasting energy, thereby improving the energetic efficiency of the oven 1.

In an alternative embodiment, the oven 1 comprises means adapted to modify the opening configuration of at least one of the inlet openings 11 based on suitable commands issued by a control unit, whether automatically or upon a selection made by the user.

The distribution system, if designed for this purpose, can thus be used for obtaining differentiated cooking results by directing more air towards specific levels. This offers the possibility of cooking, during the same cycle, foods requiring, within a certain extent, different cooking times. The system thus implemented, in addition to offering clear cooking advantages, is also advantageous in terms of energetic efficiency. The air flow is no longer delivered into a large cavity, where it would exchange heat with side surfaces of the muffle 2 not used for heating foods; this will be reflected in less energy needed for cooking foods.

In general, it is possible to achieve cooking efficiency even without necessarily employing means adapted to vary the configuration of the inlet openings 11; to this end, it becomes important to properly size the inlet openings 11 so as to obtain optimal cooking results on each shelf considered individually (in this case, the above-described cooking flexibility among the various shelves would however be lost).

Figure 3:
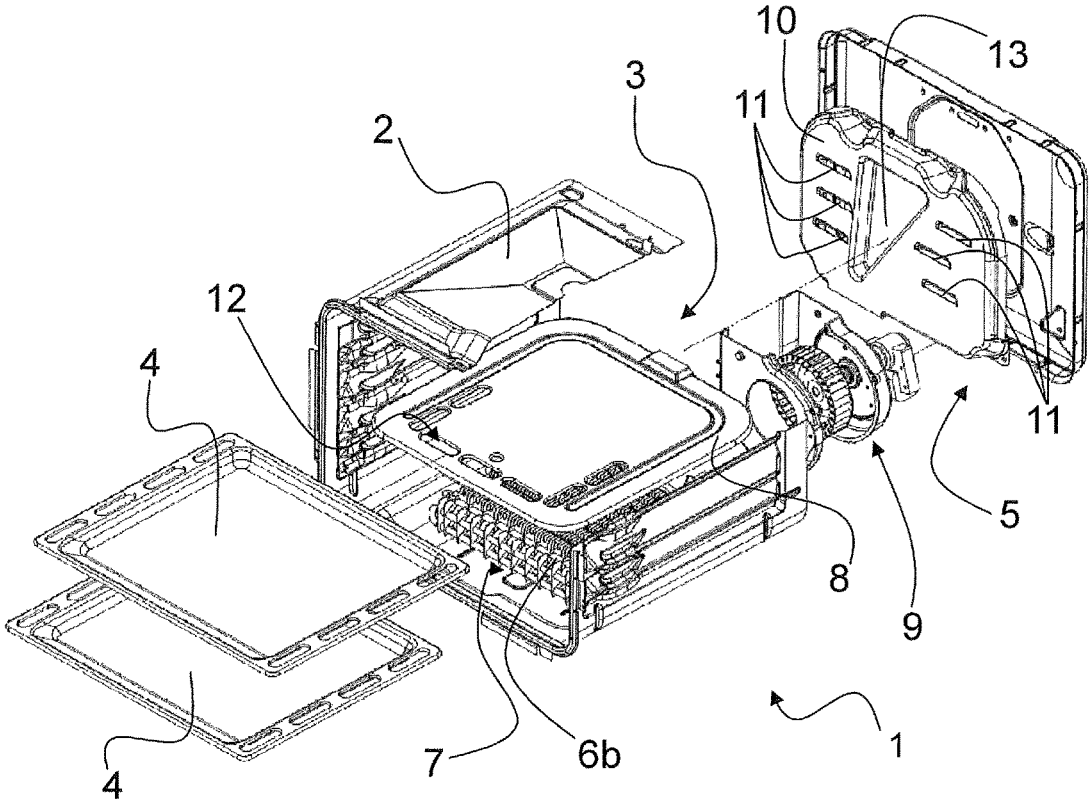
FIG. 3 is an exploded view of a second embodiment of an oven according to the present invention.

FIG. 3 illustrates a variant of the oven 1, comprising a different configuration 6*b* of the heating means 6 of FIG. 1. This variant will be described more in detail with reference to FIGS. 5 and 6.

Figure 4:
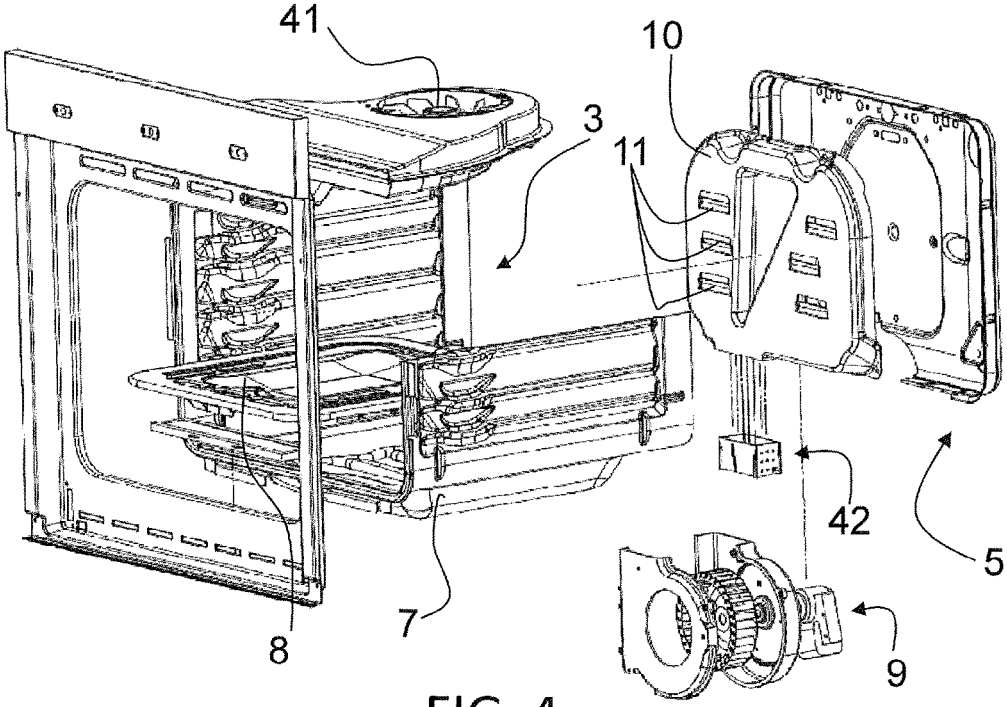
FIG. 4 is an exploded view of a third embodiment of an oven according to the present invention.

FIG. 4 illustrates an embodiment of the oven 1, comprising a further air circulation element 41, i.e. a fan located on the top surface of the cooking cavity 3, which allows direct fluidic connection between the cooking cavity 3 and an air channel arranged above the muffle 2; such elements allow the cooking fumes to be extracted from the cooking cavity 3, thereby ensuring an optimal humidity level for cooking the food.

The oven 1 of FIG. 4 comprises further heating means 42, which will be described more in detail below, positioned at the entrance of the channel 10 and downstream of the fan 9, which can be used for pyrolyzing smells transported by the heated air flow, preferably operating by incandescence at temperatures in excess of 400-500° C., or as an additional element for heating the air to be supplied into the cooking cavity 3.

Figure 5:
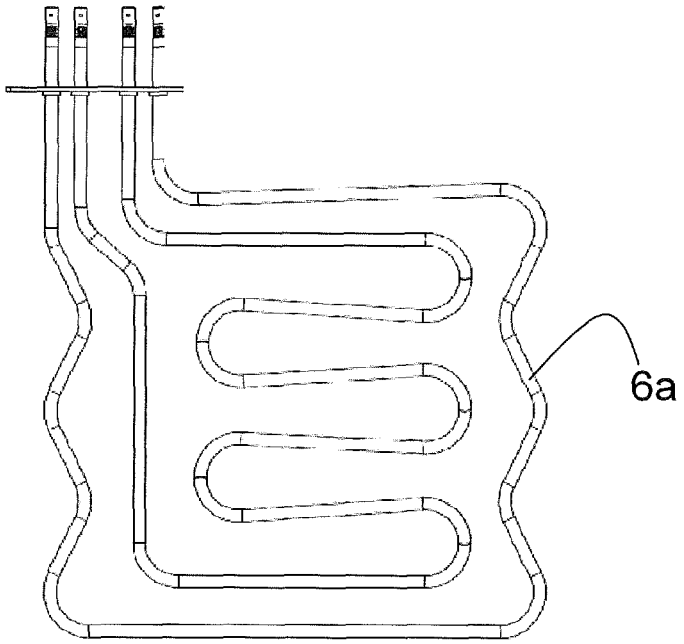
FIG. 5 shows a first embodiment of a heating element for an oven according to the present invention.
Figure 6:
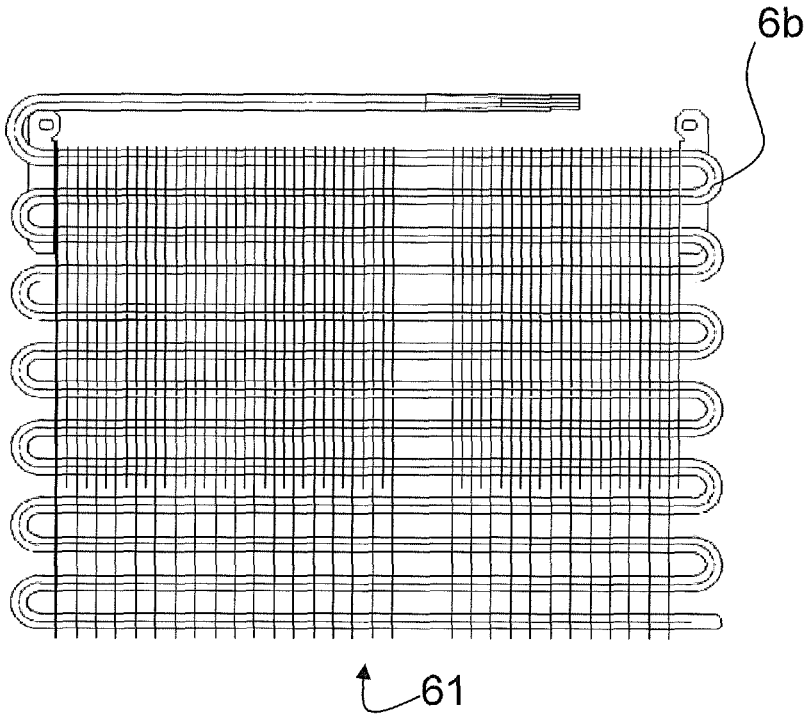
FIG. 6 shows a second embodiment of a heating element for an oven according to the present invention.

With reference to FIGS. 5 and 6, there are shown two embodiments 6*a* and 6*b* of the heating means in the oven 1, wherein the presence of at least one tubular electric resistor 6*a* is envisaged.

The tubular electric resistor 6*a* comprises a spiral element wound around it (not shown) and adapted to increase the thermal exchange with the heated air coming from the cooking cavity 3, which has already exchanged heat with the foods being cooked. In this embodiment, the tubular electric resistor 6*a* has the peculiarity of being formed by a hot pipe (resistor) on which a spiral is applied, forming a continuous fin that increases the exchange area and hence improves the efficiency of the system.

The tubular electric resistor 6*b*, instead, comprises a plurality of substantially parallel fins 61 adapted to enhance the thermal exchange with said heated air. This version of the tubular electric resistor 6*b* proves to be more efficient, and comprises a hot coil (resistor), wherein the pipes are arranged in an alternated fashion, with a series of fins 61 arranged parallel to the air flow, thus forming a heating battery.

In yet another variant (not shown), the fins 61 are replaced by a foil arranged between the two rows of pipes, the surface of which lies in the same plane as the air flow; this variant provides a more economical alternative to the finned variant of the tubular electric resistor 6*b*.

A further variant (not shown) comprises a hot battery, wherein the pipe element and the fins 61 are replaced by an incandescent wire element with a foil positioned between the filaments, the surfaces of which lie in the same plane as the air flow.

Figure 7:
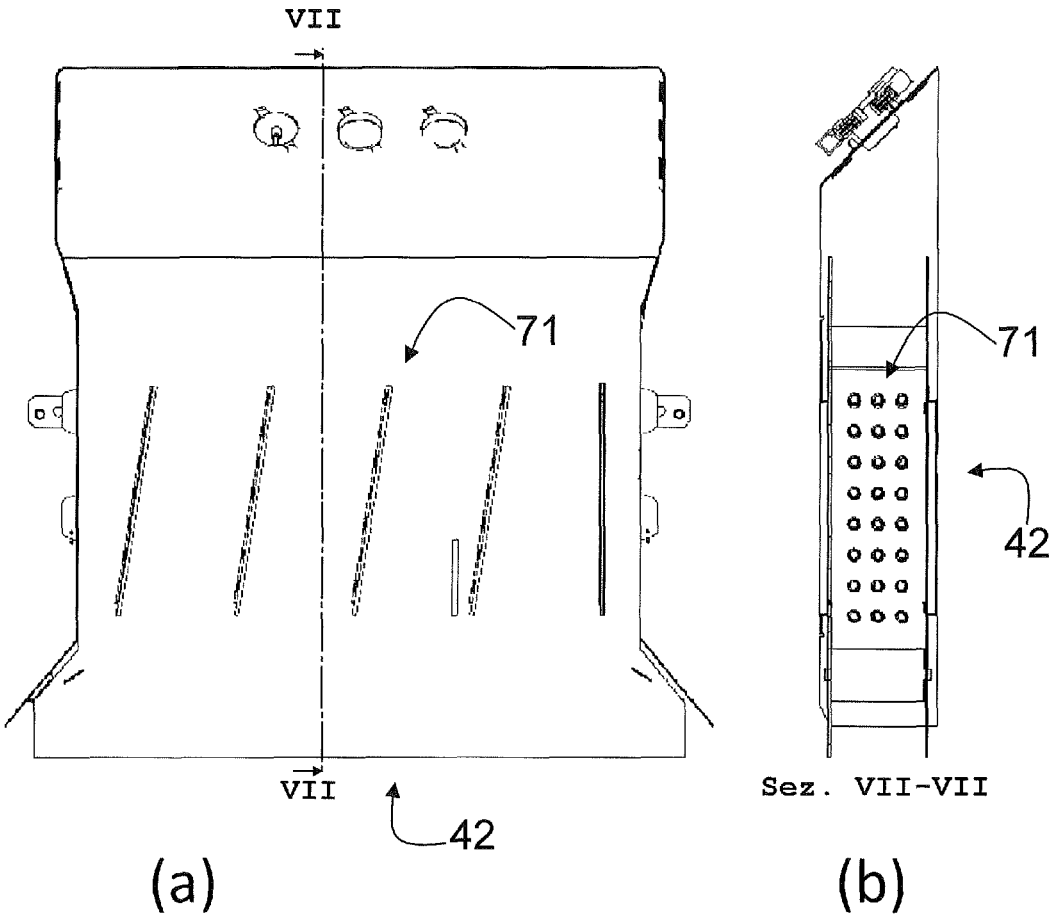
FIG. 7 shows a front view (a) and a sectional view (b) of an additional heating element in an oven according to the present invention.

With reference to FIG. 7, there is shown a preferred embodiment of the additional heating means 42 of FIG. 4, consisting of a filament heater comprising a plurality of electrically heated filaments 71 arranged transversally to the air flow that crosses the additional heating means 42. As already described, the plurality of heated filaments 71 are preferably adapted to pyrolyze smells transported by the air flow, since they operate by incandescence, and/or are adapted to additionally heat the air to be supplied into the cooking cavity 3.

In another embodiment of the oven 1 according to the present invention, in addition or as an alternative to the embodiments described so far with reference to FIGS. 1 to 7, it is envisaged to provide one or more inlet openings 11 with at least one grease filter, which reduces the fouling of the oven in general, reducing in particular the fouling of the functional elements thereof (such as the resistors and the fan), thus contributing to keeping the latter efficient by preventing deposits of cooking residues transported by the air that flows through said elements. Said grease filter may comprise, for example, metallic mesh elements that can be washed and reconditioned.

In yet another embodiment of the oven 1 according to the present invention, in addition or as an alternative to the embodiments described so far with reference to FIGS. 1 to 7, it is envisaged to provide the oven 1 with a floor 8 made of glass-ceramic, which is transparent to heat and allows the heating element 6 to be used as a radiating element, thus creating a "fast-oven" food cooking configuration.

In yet another embodiment of the oven 1 according to the present invention, in addition or as an alternative to the embodiments described so far with reference to FIGS. 1 to 7, it is envisaged to provide the oven 1 with a lower heater of the "thick-film" type, preferably applied to the floor 8, e.g. on a glassy, ceramic or metallic support, as an alternative to the above-mentioned heaters.

In the light of the above description of some preferred and advantageous embodiments of the present invention, it will be apparent to one skilled in the art that the invention may be subject to further modifications and variations.

For example, the centrifugal fan described herein may be manufactured as a single part, wherein the scroll and the air distribution element are made as one piece, as opposed to two separate pieces.

The inlet openings 11 may be in a different number than described herein, and may also have different shapes from one another.

The invention claimed is:

1. An oven comprising:

a muffle that defines a cooking cavity for containing foods to be cooked, said muffle including at least one horizontal floor, heating means adapted to heat air, ventilating means adapted to circulate said air, and at least one air distribution element comprising at least one channel adapted to receive said air circulated by said ventilating means and to allow the air to flow through the at least one channel, wherein said at least one air distribution element further comprises a plurality of inlet openings in fluidic connection with said at least one channel and adapted to supply said air from below the at least one horizontal floor and laterally into said cooking cavity, characterized in that said ventilating means includes at least one fan in fluidic connection with said at least one air distribution element, said fan being placed at least partially under a level of said at least one horizontal floor, wherein the plurality of inlet openings are defined within at least one vertical back wall of the muffle and place the at least one channel in communication with the cooking cavity.

2. The oven according to claim 1, further comprising at least one return opening for said air in said cooking cavity, said at least one return opening being located on said at least one horizontal floor.

3. The oven according to claim 2, wherein the at least one air distribution element is in communication with the at least one vertical back wall, and wherein said at least one return opening is proximal to a front wall of the muffle opposite to said at least one vertical back wall.

4. The oven according to claim 2, wherein said at least one return opening includes at least one grease filter.

5. The oven according to claim 1, wherein said fan includes an impeller in fluidic connection with a region underneath said at least one horizontal floor on an upstream side of the impeller, and in fluidic connection with said at least one air distribution element on a downstream side of the impeller.

6. The oven according to claim 5, wherein said impeller is of a centrifugal type and having an axial inlet for said air, and a radial outlet for said air.

7. The oven according to claim 1, further comprising:

a tray positioned underneath said cooking cavity, said tray being separated from said cooking cavity by said at least one horizontal floor, said tray having an inside that includes said heating means in fluidic connection with said ventilating means.

8. The oven according to claim 7, wherein said heating means includes at least one tubular electric resistor, having one of (1) a spiral element wound thereon, and which is adapted to enhance a thermal exchange with said air, and (2) a plurality of substantially parallel fins adapted to enhance the thermal exchange with said air.

9. The oven according to claim 1, further comprising:

second heating means positioned in said at least one channel and downstream of said ventilating means, said second heating means being adapted to pyrolyze any smells transported by the flow of said air.

10. The oven according to claim 1, wherein said fan is placed completely under the level of said at least one horizontal floor.

11. The oven according to claim 1, wherein the heating means is positioned beneath the at least one horizontal floor, wherein the heating means is a resistive heating element that cooperates with the at least one horizontal floor to define the at least one horizontal floor as a radiant heating element.

12. The oven according to claim 1, wherein each inlet opening of the plurality of inlet openings is positioned within the at least one vertical back wall of the muffle.

* * * * *